United States Patent [19]

van Amstel

[11] 4,445,069

[45] Apr. 24, 1984

[54] LOW-PRESSURE DISCHARGE LAMP

[75] Inventor: Antonius C. van Amstel, Eindhoven, Netherlands

[73] Assignee: U.S. Philips Corporation, New York, N.Y.

[21] Appl. No.: 449,805

[22] Filed: Dec. 14, 1982

Related U.S. Application Data

[63] Continuation of Ser. No. 178,227, Aug. 14, 1980, abandoned.

[30] Foreign Application Priority Data

Aug. 15, 1979 [NL] Netherlands ..... 7906202

[51] Int. Cl.[3] ..... H01J 17/04; H01J 61/04

[52] U.S. Cl. ..... 313/610; 313/493

[58] Field of Search ..... 313/493, 610, 245, 249, 313/308, 607

[56] References Cited

U.S. PATENT DOCUMENTS 2,612,618 9/1952 Bonadio ..... 313/308 X 4,260,931 4/1981 Wesselink ..... 313/610 X

*Primary Examiner*—David K. Moore

*Assistant Examiner*—K. Wieder

*Attorney, Agent, or Firm*—Robert S. Smith

[57] ABSTRACT

The invention relates to a compact low-pressure discharge lamp, consisting of a hollow inner member (2) which is closely surrounded by a generally cylindrical outer member (1).

Both members have a semi-spherical configuration at one end, their other ends being sealed together. At least one of the members is provided with a groove (6,7,8,9) which forms the discharge path. The groove wall, or the wall portion of the other member located opposite the groove, is provided with an electrically conducting strip (11) on its surface remote from the discharge, the strip being connected to one of said electrodes and extending along substantially the whole length of the groove. This causes the discharge to be confined solely to the groove without extending into any gap between the two members.

3 Claims, 2 Drawing Figures

LOW-PRESSURE DISCHARGE LAMP

Figure 1:
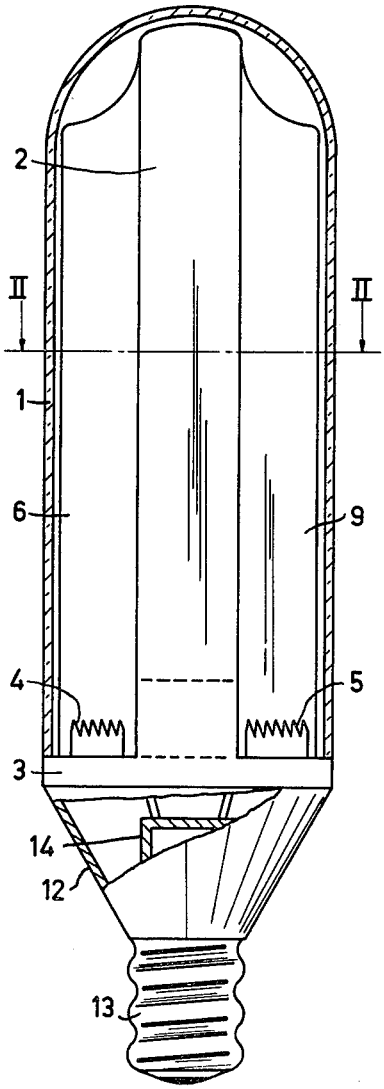

This is a continuation of application Ser. No. 178,227, filed Aug. 14, 1980 now abandoned.

The invention relates to a low-pressure discharge lamp comprising a hollow glass inner member which is closely surrounded by a predominantly cylindrical glass outer member, one end of each member being closed and the two members being sealed together at their other ends, the lamp also comprises two electrodes between which a discharge takes place during operation. The discharge is present in a discharge path formed by a groove in the wall of at least one of the two members. Such a lamp is disclosed in U.S. Pat. No. 4,095,135.

Such known compact low-pressure discharge lamps can be obtained by folding the discharge path. A typical example is a low-pressure mercury vapor discharge lamp whose inner wall is provided with a luminescent layer. Provided with a suitable lamp base (which includes, for example, an electric stabilization ballast and a starter) having a screw or bayonet cap, this lamp may be used as an alternative for incandescent lamps for general lighting purposes. The shape of the discharge path is determined by the shape of the groove in one of the members and is, for example, folded back and forth.

The inner member is enclosed by the outer member with some clearance so that, during production of the lamps, the members can be pushed one over the other without damage to, for example, luminescent layers in low-pressure mercury vapor discharge lamps. These layers are applied onto the walls before the two bodies are pushed one into the other. Such a construction has the further advantage that, during processing "evacuation" of the lamp is effected relatively rapidly. For this purpose, the larger the clearance, or gap, between the two members the simpler is their assembly. On the other hand, two large a gap would allow the discharge to flash over between two adjacent groove portions via the intervening gap.

Although in most cases the clearance (for example 0.5 mm) between the walls of the members is sufficiently discharge-tight (that is to say that, during operation of the lamp, flashover of the discharge, between two neighboring groove portions via the gap can hardly occur) it is desirable to limit the risk of flashover of the discharge to a minimum, as the occurence of flashover as the result of jumping of the discharge reduces the length of the discharge path and, hence, adversely affects the luminous flux and the efficiency of the lamp negatively. Jumping of the discharge during ignition or operation of the lamp also reduces the life of the electrodes and of the starter.

The invention has for its object to provide a lamp of the type described in the opening paragraph, wherein flash over of the discharge is prevented. Such a lamp is characterized in that, in order to cause the discharge to flow through solely the groove during operation, the wall of at least one of the members is provided in the region of the groove with an electrically conducting layer, which is electrically connected to one of said electrodes, the length of the conducting layer being substantially equal to the length of the discharge path.

From experiments it was found that owing to the presence of a conducting strip (whose resistance value can be varied within wide limits) which is connected to an electrode, the discharge invariably chooses the proper path through the groove during ignition of the lamp as well as during operation. A further advantage of a lamp according to the invention is that the clearance between the two members can be chosen to be relatively large. It was found that in a lamp according to the invention the discharge is held entirely in the groove, even in cases where the clearance is so large (for example 2 mm) that it would not be discharge-tight.

It should be noted that it is known to apply a conducting layer in low-pressure discharge lamps, for example low-pressure mercury vapor discharge lamps, but this is exclusively as an auxiliary means to facilitate starting of the lamp (see, for example, German Pat. specification No. 889,951, which describes a lamp having a lamp vessel comprising two communicating chambers separated by a partition, which is connected to the wall of the lamp vessel. The starting strip is provided on the partition).

In an embodiment of a lamp according to the invention the conducting layer is provided on the wall surface at the inner member remote from the discharge path.

The conducting layer is then present in the interior of the lamp, which is either not or hardly accessible to the user. The lamp can then be safely touched Additional provisions for this purpose, for example connecting the strip to a supply wire for an electrode by way of a high resistance may then be dispensed with.

The invention is preferably used in compact low-pressure mercury vapor discharge lamps, for example of a type wherein only those portions of the groove wall which face the discharge and the wall portions, facing this groove, of the other member are coated with a luminescent layer, as described in United Kingdom patent specification No. 2,014,357.

It is also possible to use a lamp according to the invention as a low-pressure sodium discharge lamp or as a low-pressure mercury vapor discharge lamp without a luminescent layer, for example a lamp suitable for radiation purposes.

An embodiment of a low-pressure discharge lamp according to the invention will now be described with reference to the accompanying drawing.

In the drawing

Figure 2:
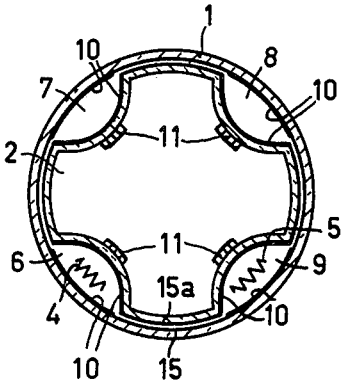

FIG. 1 shows a perspective view of a low-pressure mercury vapor discharge lamp according to the invention and FIG. 2 is a cross-sectional view of a lamp of FIG. 1 through the plane II—II.

The lamp shown in FIG. 1 comprises a generally cylindrical glass outer member 1, one end of which has a semi-spherical configuration, which closely surrounds a glass inner member 2. The outer member is sealed in a gas-tight manner at its end 3 to the inner member 2 with glass enamel. The lamp comprises two electrodes 4 and 5 between which a discharge takes place, during operation of the lamp in a so-called folded discharge space formed by a groove in the wall of the inner member 2. The groove comprises portions denoted by numerals 6, 7, 8 and 9 (see also FIG. 2). The discharge space is limited by the groove and by the wall portions of the outer member 1 opposite the groove. The discharge flows from electrode 4 upwards (as viewed in FIG. 1) via groove portion 6, downwards via groove portion 7, upwards via portion 8 and downwards via the portion 9 to electrode 5. Only the groove walls facing the discharge and the inner surface portions of the wall of the outer member located opposite the groove are coated with a luminescent layer 10. A conducting layer 11 (see FIG. 2) is provided on the wall surface of the inner member remote from the discharge space in the region of the groove in order to lead the discharge through the groove portions during operation. The conducting layer contains copper, carried on the wall with help of a suspension of water and is electrically connected to a supply wire of an electrode. It extends over substantially the entire length of the discharge path. The lamp includes a lamp base 12 with a screw cap 13. The lamp base includes an electric stabilization ballast 14 and a starter (not shown).

In a practical embodiment of a lamp according to the invention a 2.0 mm gap was present between the inner member and the outer member. The luminescent material 10 consisted of a mixture of two phosphors, namely green-luminescing, terbium-activated cerium magnesium aluminate and red-luminescing, trivalent europium-activated yttrium oxide. The folded discharge path had a length of 40 cm. The discharge space contains 8 mg of mercury. With a rare gas filling of argon (400 Pa) the luminous flux was 1000 lumen at an applied power to the lamp (i.e. including the electric ballast) of 19 W. It was found that with the above-mentioned gap and without a conducting strip, the discharge tended to extend into the gap, hence causing blackening of the wall portions in the gap, (for example portions 15 and 15*a*) which had not been coated with luminescent material. When a conducting layer, comprising a copper strip having a width of 2 mm, a thickness of 25 $\mu$m and a total resistance of 150 ohm, was present the discharge was invariable confined to the groove during operation. Thus the provision of the conductive strip 11 allows a relatively large gap to exist between the inner and outer members. This not only avoids the blackening effect and also possible tracking of the discharge between adjacent groove portions, but also simplifies manufacture and assembly in that wider dimensional tolerances can be applied to at least one of the two members.

In the embodiment described above, the conductive layer is provided on the surface of the inner member remote from the discharge path. It is alternatively possible to provide the conductive layer on the wall surface of either member facing the discharge path, in which case the conductive layer is located between the wall of the member concerned and the luminescent layer 10.

What is claimed is:

1. A low-pressure discharge lamp comprising a hollow glass inner member which is closely surrounded by a predominantly cylindrical glass outer member, one end of each member being closed and the two members being sealed together at their other ends, the lamp also comprising two electrodes between which a discharge takes place during operation of the lamp, said discharge being present in a discharge path formed by a groove in the wall of at least one of the two members, said groove being serpentine shaped, characterized in that in order to cause the discharge to flow solely through the groove during operation, the wall of at least one of the members is provided proximate to the region of the groove with an electrically conductive layer which is electrically connected to one of said electrodes, the length of the conductive layer being substantially equal to the length of the discharge path, the conductive layer being provided on the wall surface of the inner member remote from the discharge path.

2. A low-pressure discharge lamp as claimed in claim 1, characterized in that the conducting layer comprises copper.

3. A low-pressure discharge lamp as claimed in claim 1, wherein said conducting layer has a width which is substantially equal to 2 mm.

* * * * *